US006751938B1

(12) United States Patent
Llongueras

(10) Patent No.: US 6,751,938 B1
(45) Date of Patent: Jun. 22, 2004

(54) INDEPENDENT TORSIONING UNIT

(76) Inventor: Jordi Galan I Llongueras, Murillo 16, E-08229 Terrassa (ES)

( * ) Notice: Subject to any disclaimer, the term of this patent is extended or adjusted under 35 U.S.C. 154(b) by 324 days.

(21) Appl. No.: 09/890,740

(22) PCT Filed: Jul. 21, 2000

(86) PCT No.: PCT/ES00/00269

§ 371 (c)(1),
(2), (4) Date: Feb. 19, 2002

(87) PCT Pub. No.: WO01/40557

PCT Pub. Date: Jun. 7, 2001

(30) Foreign Application Priority Data

Dec. 3, 1999 (ES) ..... P 9902674

(51) Int. Cl.[7] ..... D01H 13/10; D01H 13/32

(52) U.S. Cl. ..... 57/90; 57/264; 57/265

(58) Field of Search ..... 57/90, 264, 265

(56) References Cited

U.S. PATENT DOCUMENTS 3,943,689 A * 3/1976 Kunz et al. ..... 57/264
4,569,192 A * 2/1986 Yamada et al. ..... 57/317
4,584,875 A * 4/1986 Woo et al. ..... 73/160
5,237,805 A * 8/1993 Menegatto ..... 57/16
5,706,642 A * 1/1998 Haselwander ..... 57/264

FOREIGN PATENT DOCUMENTS

EP 926090 A2 * 6/1999 ..... B65H/59/38

* cited by examiner

*Primary Examiner*—John J. Calvert
*Assistant Examiner*—Shaun Hurley

(57) ABSTRACT

The independent torsioning unit consists of two different units: the case frame and the programming and control unit. The case frame houses the spindle axis, the electrical motor, the drive belt, the yarn guide, the vertical deflection roller, the horizontal deflection pulley and the impulse reader. The programming and control unit consists of a processor, the programming keyboard and a frequency converter that supplies and controls the motor. The independent torsioning unit is used as an auxiliary feeding machine that enhances the performance of any type of main processing machine.

2 Claims, 2 Drawing Sheets

INDEPENDENT TORSIONING UNIT

OBJECT OF THE INVENTION

The object of the present invention refers, as its title indicates, to an independent torsioning unit used, through this torsioning unit, to feed spinning, twisting and other operating machines, in the textile industry, with materials derived from glass, polyamide, technical threads and other products.

BACKGROUND OF THE INVENTION

A series of machines are used in the textile industry with the purpose of making yarn, twisting threads, manufacturing cords and other similar operations, that are fed from several static reels by proper means of said machines. These means are feeding rollers that are synchronised with the spindles of said machines in order to provide the desired torsioning degree to the carried out work.

The productivity of the tandem formed by the spindles and the corresponding feeding rollers is limited by the feeding speed in relationship to the necessary torsioning degree for each work.

DESCRIPTION OF THE INVENTION

The independent torsioning unit is constituted by two clearly differentiated units: a case-frame and a programming and control unit. In the case-frame are housed a spindle and a reel, an electric motor, a drive belt, a yarn guide, a vertical deflection roller, a horizontal deflection sheave and a pulse reader. The spindle is a component that comprises several pieces, preferably vertical, that rotates on a support with a bearing that is fixed on the plate of the case-frame. The reel is introduced on said spindle with material that will be processed and the spindle is endowed with orientation capacity comprised between 0° and 45° (for the spindle types requiring it). At the bottom of said spindle it is attached a pulley that is moved, through a flat, preferably geared belt, by the electric motor pulley.

The programming and control unit comprises a processor, a programming keyboard and a frequency converter, which supplies and manages the motor. The thread to be processed can follow two different paths, depending on the spindle type used: either an upward path, the thread going to the yarn guide and to the upper deflection sheave, or a descending path the thread going by the lower deflection sheave, to arrive to the horizontal deflection sheave, that facilitates the thread withdrawal to the main processing machine.

BRIEF DESCRIPTION OF THE DRAWINGS

For a good understanding of the object of the present invention, in what follows a preferred embodiment of the independent torsioning unit object of the present invention is described, based on the enclosed figures.

PREFERRED EMBODIMENT OF THE INVENTION

Figure 1:
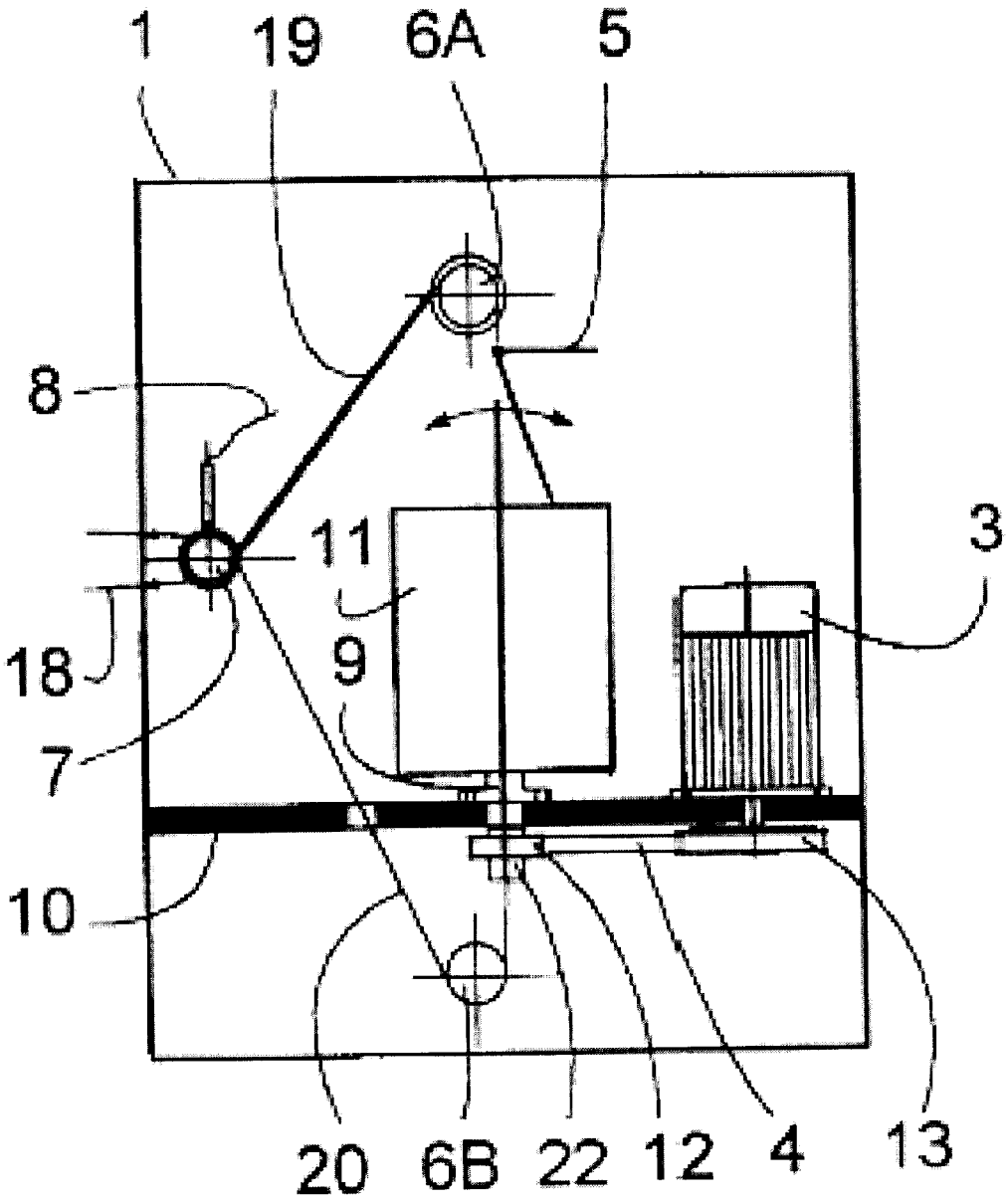
FIG. 1.—Schematic view of the independent torsioning unit.
Figure 2:
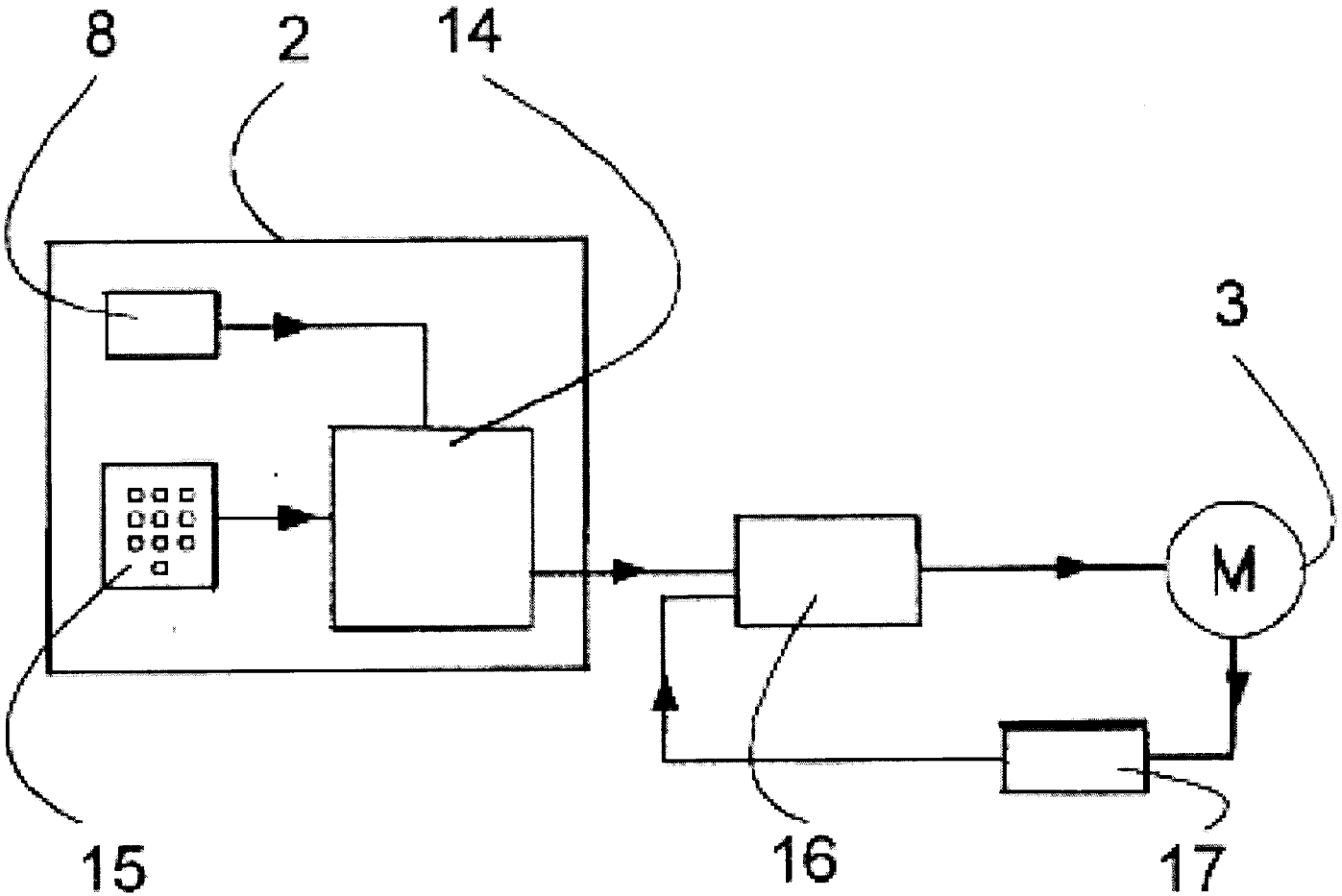
FIG. 2.—Electric diagram of the independent torsioning unit.

The description that will be accomplished about this preferred embodiment refers to an independent torsioning unit of a single spindle, but said unit can comprise an amount of spindles, between one unit and three hundred units, as a function of the characteristics of the main processing machine to be fed. In the same way, the spindle shown schematically is not a spindle of a certain type, since in the independent torsioning unit it is possible to use any type of the spindles used to feed spinning, twisting and other operating machines in the textile industry with materials derived from glass, polyamide, technical threads and other products, like rings spindles for twisting and spinning, hollow axle spindles, double twisting spindles of the so called "boat" system, spindles of the so called system "cabling", double, triple and quadruple twisting spindles of horizontal work, etc.

Two clearly differentiated units constitute the independent torsioning unit: the case-frame (1) and the programming and control unit (2). In the case-frame (1) are housed the spindle and the reel (11), the electric motor (3), the drive belt (4), the yarn guide (5), the vertical deflection roller (6), the horizontal deflection sheave (7) and the pulse reader (8). The spindle (22) is a component, preferably vertical, formed by several pieces, that rotates on a support with bearing (9) that is fixed on the plate (10) of the case-frame (1). The reel (11) is introduced on said spindle (22) with the material that will be processed and the spindle is endowed with orientation capacity comprised between 0° and 45° (for the spindle types requiring it). At the bottom of said spindle (22) it is coupled a pulley (12) that is driven through a flat, preferably geared belt (4), by the electric motor (3) pulley (13).

The programming and control unit comprises the processor (14), the programming keyboard (15) and the frequency converter (16), which supplies and manages the motor (3) that in some cases it is endowed of its own pulse reader (17).

The thread (18) to be processed can follow two different paths, depending on the spindle (22) type used, as it was disclosed in the introductory preamble of this section, either an upward path (19), the thread (18) going to the yarn guide (5) and to the upper deflection sheave (6A), or a descending path (20), the thread going by the lower deflection sheave (6B), to arrive to the horizontal deflection sheave (7), that facilitates the thread withdrawal to the main processing machine.

To start the independent torsioning unit operating process, this unit is connected to the electric power supply, the desired twisting degree that is being provided to the thread (18) it is programmed through the programming keyboard (15) and said thread (18) that leaves the horizontal sheave (7) is spliced to the thread that is transforming the main processing machine. Since said machine is programmed to operate at a certain speed, the lineal output speed of the thread (18) it is conditioned by said speed, said speed being measured by the pulse reader (8) that sends the information to the processor (14); said processor (14) compares said output speed of the thread (18) with the twisting degree programmed through the keyboard (15), thus generating the necessary command to be sent to the frequency converter (16), that delivers the necessary power to the motor (3), so that it rotates at the speed suitable to get the twisting degree as a consequence of the spindle (22) rotation, with which the thread (18) will enter to the main processing machine. On the other hand and only when the task to be performed requires a high precision degree, the frequency converter (16) by itself compares the command sent by the processor (14) with the motor (3) pulse reader (17) real reading to adjust the speed of said motor (3) again.

The present invention nature being described sufficiently, as well as a way of taking it into a practical embodiment, we only need to add that it is possible to introduce shape, materials and arrangement changes to the present invention as a whole or to its forming parts, provided that said changes do not vary substantially the invention features that are claimed hereunder.

What is claimed is:

1. Independent thread torsioning unit to feed spinning, twisting and other operating machines that perform traction of a thread (18), being this independent thread torsioning unit of the type such as those having a spindle (22), an electric motor (3), a drive belt (4), a yarn guide (5), two alternative vertical deflection rollers (6A) and (6B), a horizontal deflection sheave (7), a pulse reader (8), a programming and control unit (2) integrated by a processor (14), a programming keyboard (15) and a frequency converter (16) which supplies and manages the electric motor (3), said control unit (2) storing a desired value of torsion degree of thread (18) introduced by means of the keyboard (15), and said pulse reader (8) measuring the speed of the thread (18) when said thread (18) leaves the independent thread torsioning unit and sending the information of said speed of the thread (18) to the processor (14);

wherein said processor (14) calculates the necessary turning speed of said electric motor (3) as a function of said speed of the thread (18) in order to obtain said desired torsion degree of the thread (18) and sends the appropriate command to the frequency converter (16), said frequency converter (16) then providing the necessary power to the motor (3) in order to make said motor (3) rotate at the appropriate speed so that the thread (18) obtains the desired torsion degree as consequence of the spindle (22) rotation.

2. Independent thread torsioning unit, according to claim 1, wherein when a high precision of the torsioning degree is required, said motor (3) is endowed with its own pulse reader (17) whose output is fed-back to the frequency converter (16), that by comparison with the command sent by said processor (14) adjusts the turning speed of said motor (3) that produces the torsion.

* * * * *